US005406775A

United States Patent [19]

Tacchi et al.

[11] Patent Number: 5,406,775

[45] Date of Patent: Apr. 18, 1995

[54] METHOD AND DEVICE FOR FEEDING PORTIONS OF WRAPPING MATERIAL ON A CIGARETTE PACKING MACHINE

[75] Inventors: Alver Tacchi; Alessandro Minarelli, both of Bologna, Italy

[73] Assignee: G.D Societa' Per Azioni, Bologna, Italy

[21] Appl. No.: 72,974

[22] Filed: Jun. 4, 1993

[30] Foreign Application Priority Data

Jun. 17, 1992 [IT] Italy ..... BO92A0245 U

[51] Int. Cl.[6] ..... B65B 11/28; B65B 41/10

[52] U.S. Cl. ..... 53/466; 53/234; 53/389.4; 53/389.5

[58] Field of Search ..... 53/466, 234, 389.5, 53/389.4, 389.3, 389.2

[56] References Cited

U.S. PATENT DOCUMENTS

| | | | |
|---|---|---|---|
| 2,279,843 | 4/1942 | Smith et al. | 53/234 |
| 3,035,379 | 5/1962 | Cloots | 53/466 X |
| 3,075,325 | 1/1963 | Liedtke . | |
| 3,527,014 | 9/1970 | Wahle et al. | 53/466 X |
| 3,881,719 | 5/1975 | Schmermund | 53/234 X |
| 4,495,746 | 1/1985 | Focke et al. | 53/389.5 X |
| 4,918,901 | 4/1990 | Gamberini et al. . | |

FOREIGN PATENT DOCUMENTS

| | | | |
|---|---|---|---|
| 519402 | 12/1992 | European Pat. Off. | 53/466 |

*Primary Examiner*—Linda B. Johnson

*Attorney, Agent, or Firm*—Marshall, O'Toole, Gerstein, Murray & Borun

[57] ABSTRACT

On a cigarette packing machine, portions of wrapping material are formed from a strip travelling at a first constant speed, are accelerated on suction belts to a second speed, and are transferred by a suction roller into a position astride respective seats on a conveyor drum designed to step feed, to an unloading station, groups of cigarettes housed inside respective seats; the surface speed of the suction roller being so varied as to be maintained, at all times, greater than the travelling speed of the belts, and equal, for a given time period, to the surface speed of the conveyor drum.

11 Claims, 2 Drawing Sheets

METHOD AND DEVICE FOR FEEDING PORTIONS OF WRAPPING MATERIAL ON A CIGARETTE PACKING MACHINE

BACKGROUND OF THE INVENTION

The present invention relates to a method of feeding portions of wrapping material on a cigarette packing machine.

In particular, the present invention relates to a method of feeding, on a cigarette packing machine, portions of wrapping material from which to form the inner wrapping of respective packets of cigarettes.

On cigarette packing machines, groups of cigarettes, each normally comprising twenty cigarettes arranged in three layers, are formed inside respective pockets of a conveyor, and are normally fed successively to a rotary head normally presenting a number of seats, each designed to receive a respective group of cigarettes. Once inside said seat, each group is fed, by rotating the head through a given angle about its axis, to a folding station, which is also fed successively with portions of wrapping material. At the folding station, each group of cigarettes is normally pushed radially out of the seat and against a respective portion of wrapping material, and is fed, together with the wrapping material, into an outer radial pocket on a wrapping wheel, so that the wrapping material is folded in a U about the respective group of cigarettes as this is inserted inside the pocket on the wrapping wheel.

According to U.S. Pat. No. 4,918,901, said portions of wrapping material are made of foil, and are fed to the folding station along a guide with an end stop element on which the foil portions are arrested successively just before receiving the respective groups of cigarettes. That is, on being cut transversely at a given rate off a continuous strip, the foil portions are engaged at the front end by suction elements on the rotary head, and are fed along the guide until they are arrested on the stop element in a substantially vertical folding position suitable for receiving the respective groups of cigarettes.

The above known feed device has been found to operate excellently when dealing with portions of material with a high degree of rigidity, such as foil, but is substantially unsuitable for feeding portions of substantially nonrigid material, such as the biodegradable materials recently employed in place of foil, which tend to curl if not controlled constantly along the whole length of the portion as they are fed to the folding station.

SUMMARY OF THE INVENTION

It is an object of the present invention to provide a method of correctly feeding portions of substantially nonrigid wrapping material to said folding station.

According to the present invention, there is provided a method of feeding portions of wrapping material on a cigarette packing machine, said portions being produced by transversely cutting a strip fed at a first given speed, and the method being characterized by the fact that it comprises stages consisting in feeding each portion, via first movable retaining means, at a second given speed; and in transferring each portion, via second retaining means, from said first retaining means to conveyor means for a succession of groups of cigarettes housed inside respective seats equally spaced along the conveyor means; each portion being transferred on to the conveyor means in a position astride a respective seat; the conveyor means being step-operated at a given variable speed; and said second retaining means being operated at a third speed, which is maintained greater at all times than said second speed, and is varied so as to equal, instant by instant and for a given length of time, said variable speed.

According to the above method, said second speed is preferably maintained constantly greater than said first speed, and is preferably a constant speed.

The present invention also relates to a device for feeding portions of wrapping material on a cigarette packing machine, the device comprising step-operated conveyor means for a succession of groups of cigarettes housed inside respective seats equally spaced along the conveyor means; means for supplying a continuous strip of wrapping material at a first given speed; cutting means for cutting said portions off said strip; and means for feeding each said portion on to said conveyor means and into an operating position astride a respective said seat; characterized by the fact that said feed means comprise first retaining means for feeding each portion at a second given speed; second retaining means for transferring each portion from said first retaining means to said conveyor means and into said operating position; and drive means connected to and for operating said second retaining means at a third speed greater at all times than said second speed; said drive means being designed to cyclically vary said third speed so that it equals, instant by instant and for a given length of time, the variable travelling speed of said conveyor means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
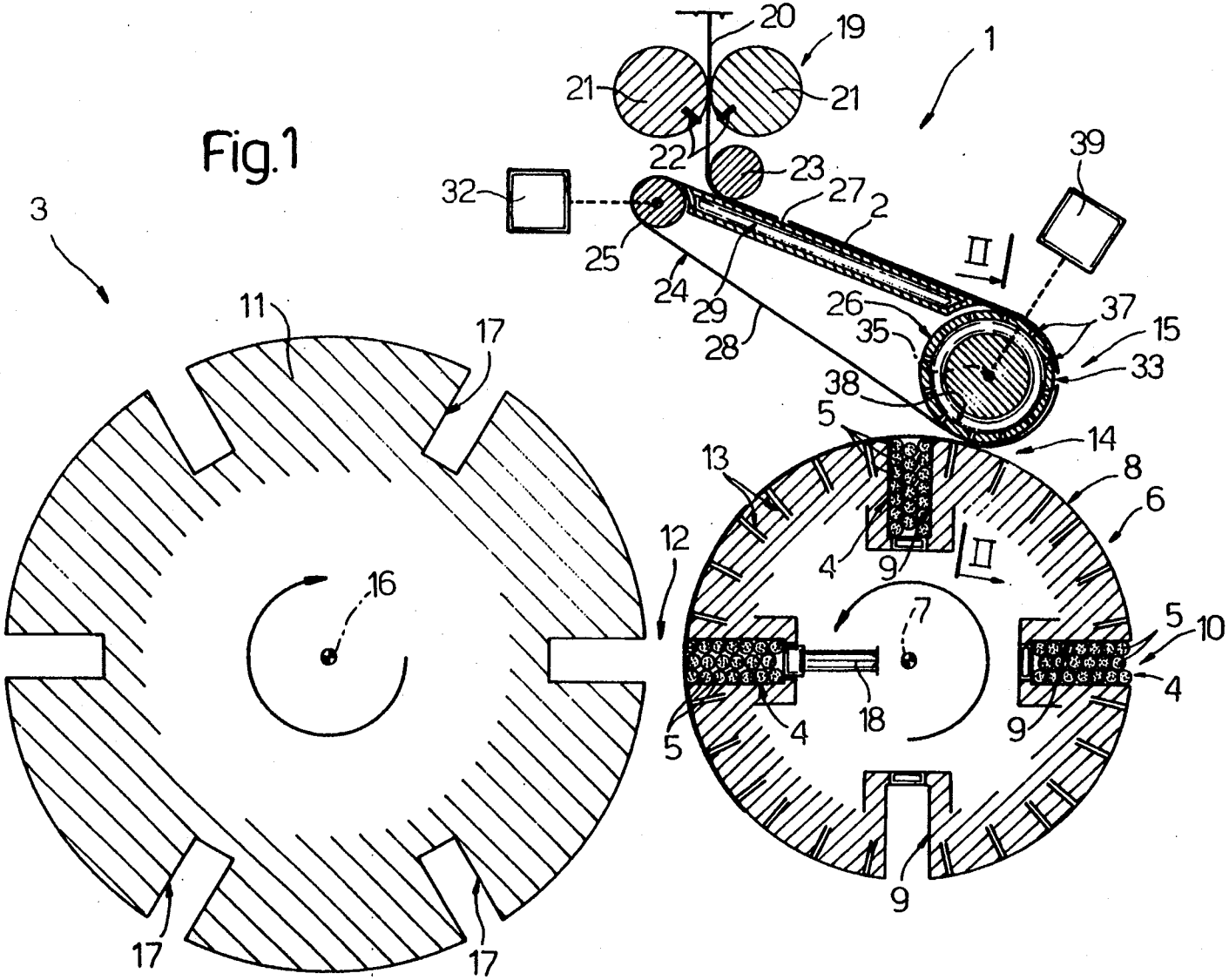
FIG. 1 shows a lateral section, substantially in block form, of a preferred embodiment of the device according to the present invention.

Number 1 in FIG. 1 indicates a device for feeding a succession of portions 2 of wrapping material along a given path on a packing machine indicated as a whole by 3. Each portion 2 preferably consists of substantially nonrigid biodegradable material, for wrapping a respective group 4 of cigarettes normally consisting of twenty cigarettes 5 arranged in three layers, and defining the content of a respective packet of cigarettes (not shown).

Device 1 comprises a drum 6 mounted for rotation on a supporting frame (not shown) so as to rotate in steps about its axis 7 and anticlockwise in FIG. 1. Drum 6 is operated in known commercially available manner by a known Maltese cross device (not shown) for transforming a continuous rotation into an intermittent or stepped rotation, and presents, on its outer cylindrical surface 8, a number of equally-spaced seats 9, each designed to receive a respective group 4 from a known conveyor (not shown) at loading station 10, and to feed group 4 on to a folding wheel 11 at unloading station 12.

In addition to groups 4, drum 6 also receives, on surface 8, a succession of portions 2, which are retained by means of a number of suction conduits 13. Each portion 2 is fed on to surface 8 at a transfer station 14 between stations 10 and 12, and by a feed unit 15, so as to assume, on surface 8, an operating position astride the inlet of a respective seat 9.

Folding wheel 11 is substantially tangent to drum 6 at station 12; is step-rotated clockwise (in FIG. 1) about its axis 16 parallel to axis 7; and presents a number of radial pockets 17, each of which is arrested in station 12 facing a respective seat 9, so as to receive from drum 6 a respective group 4 expelled in known manner from respective seat 9 by a radial pusher 18, which, when operated, provides in known manner for simultaneously feeding group 4 and respective portion 2 into respective pocket 17, and so folding portion 2 in a U about group 4.

Unit 15 is located between drum 6 and a known supply unit 19 for producing portions 2 from a continuous strip 20, and which, together with unit 15, forms part of device 1. Unit 19 comprises a pair of substantially tangent, counter-rotating rollers 21 for feeding strip 20 to unit 15 at a constant speed VI, and each of which presents a radial blade 22 cooperating cyclically with blade 22 on the other roller 21 so as to cut off portions 2. Unit 19 also comprises a guide roller 23 parallel to rollers 21 and to axes 7 and 16, and located between rollers 21 and unit 15 so as to guide portions 2 on to unit 15.

Unit 15 comprises two parallel endless suction belts 24 (only one shown in FIG. 1) mutually spaced side by side, and each looped about two rollers 25 and 26 (FIG. 2) parallel to rollers 21 and which divide respective belt 24 into a delivery branch 27 and a return branch 28. Branches 27 are substantially tangent to roller 23, and each is positioned so as to close a known suction box 29 connected, on one side, in known manner (not shown) to a suction device (not shown), and communicating externally, on the other side, through a number of holes 30 (FIG. 2) formed through belts 24.

Rollers 26 are positioned adjacent to drum 6, and are each defined by the outer ring of a respective roller bearing 31; while rollers 25 are integral and coaxial with each other, are positioned adjacent to unit 19 and at a distance from rollers 26 substantially equal to the required length of portions 2 measured in the travelling direction of portions 2, and are connected to a motor 32 for operating belts 24 at a constant speed V2 greater than the travelling speed V1 of strip 20.

Figure 2:
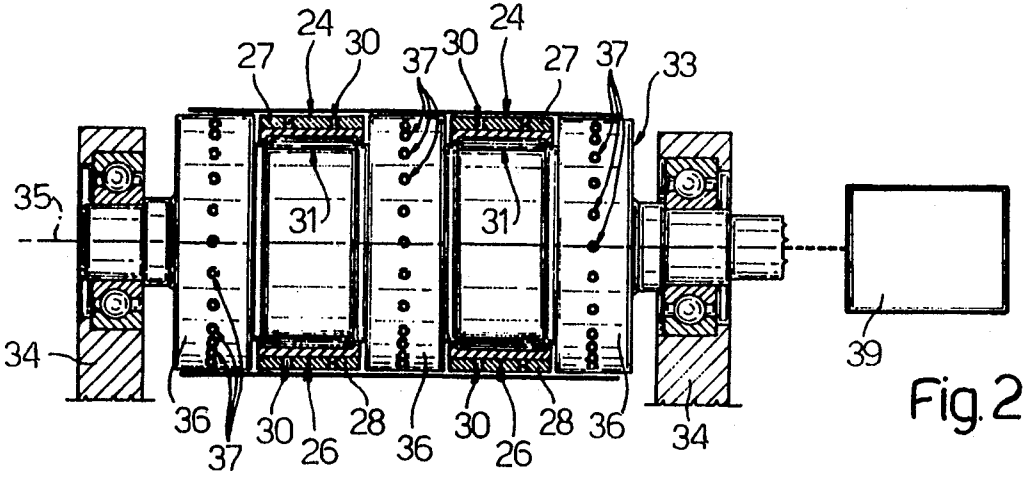
FIG. 2 shows a larger-scale section, with parts removed for clarity, along line II—II in FIG. 1.

As shown in FIG. 2, bearings 31 are housed inside respective intermediate annular grooves of a suction roller 33 forming part of unit 15, and the outer surface of which is tangent to both drum 6 and the outer surface of belts 24 at station 14. More specifically, roller 33 is supported on a frame 34 so as to rotate, in relation to frame 34 and clockwise in FIG. 1, about axis 35 parallel to axis 7. The outer surface of roller 33 is divided into three cylindrical bands 36, one located centrally between, and the other two outwards of, bearings 31.

Each band 36 is at least partly coplanar with the outer surface of the portion of belts 24 looped about respective rollers 26, and presents a number of radial holes 37 communicating externally at one end, and at the other end with an annular chamber 38 formed inside roller 33 and in turn communicating with a known suction device (not shown).

Roller 33 is connected to what is usually referred to as a "brushless" motor 39 by which it is rotated about axis 35 at a speed V3 varying according to a given law but greater at all times than the travelling speed V2 of belts 24.

In actual use, the free end portion of strip 20 is fed by rollers 21 and roller 23 into contact with delivery branches 27 of belts 24, which, being operated at speed V2 greater than the surface speed V1 of rollers 21, slide beneath said end portion of strip 20 and maintain strip 20 in position by means of suction. On encountering each other, blades 22 of rollers 21 cut strip 20 into a portion 2, which adheres to belts 24 by which it is immediately accelerated up to speed V2 and fed on to roller 33. Portion 2 is retained by suction on bands 36 of roller 33, which provides for further accelerating portion 2 up to variable speed V3 greater at all times than speed V2.

Figure 3:
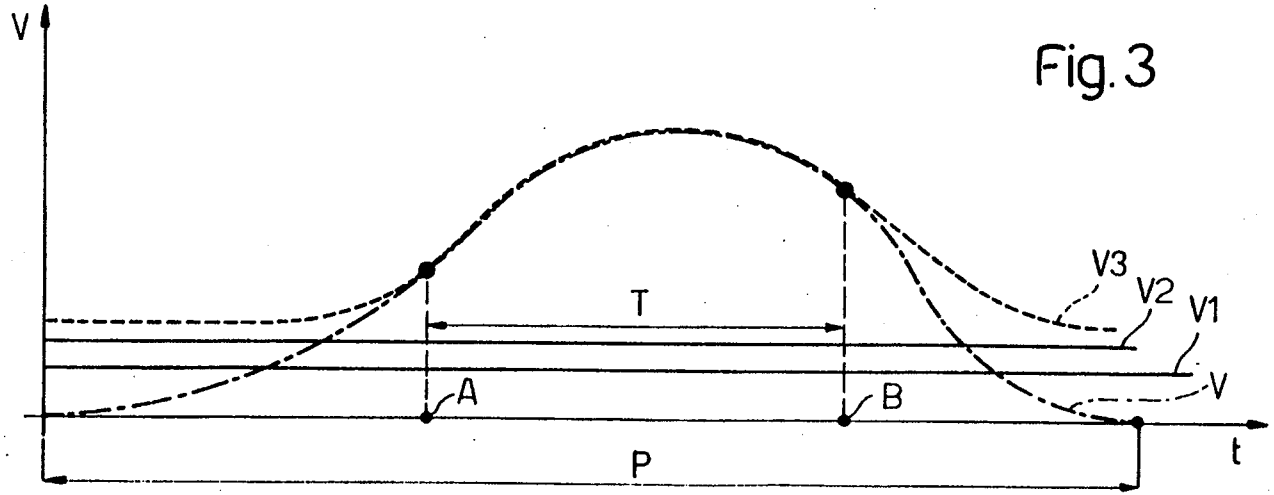
FIG. 3 shows a speed-time graph of some of the components on the FIG. 1 device.

As shown in the FIG. 3 graph, one curve of which indicates the variation in the surface speed V of drum 6 in the course of one operating step P, motor 39 is so controlled as to gradually accelerate portion 2 until its speed equals the surface speed V of drum 6 at start point A of a given time period T over an intermediate portion of operating step P, and to maintain speed V3 substantially equal, instant by instant, to speed V up to end point B of period T, which is long enough to enable the whole of portion 2 to be transferred from roller 33 to drum 6.

The present invention therefore provides, not only for controlling the position of each portion 2 over its entire length and throughout its transfer from unit 19 to station 12, but also for maintaining it substantially taut and so compensating for the substantial lack of rigidity of portion 2.

We claim:

1. A method of feeding portions of wrapping material on a cigarette packing machine, the method comprising:

feeding said portions along a first path and at a first given linear speed (V1) to a second path;

advancing each portion along said second path at a second given linear speed (V2);

transferring each portion at a third given linear speed (V3) from said second path to conveyor means for a succession of groups of cigarettes housed inside respective seats equally spaced along the conveyor means, each portion being transferred onto the conveyor means in a position astride a respective seat;

step-operating the conveyor means at a given variable linear speed (V); and said third speed (V3) being maintained greater at all times than said second speed (V2), and being varied so as to equal, instant by instant and for a given length of time, said variable speed (V) to maintain said portions taut during said feeding and transferring.

2. A method as claimed in claim 1, wherein said second speed (V2) is maintained constantly greater than said first speed (V1).

3. A method as claimed in claim 2, wherein said second speed (V2) is a constant speed.

4. A method as claimed in claim 1, wherein said portions are advanced along said second path and during said transfer by first and second suction retaining means.

5. A device for feeding portions of wrapping material on a cigarette packing machine, the device comprising:

step-operated conveyor means having respective seats equally spaced along the conveyor means for advancing, at a variable travelling speed (V), a succession of groups of cigarettes housed inside said respective seats;

means for advancing a succession of said portions along a first path and at a first given linear speed (V1) to a second path;

feed means for feeding each said portion along said second path and onto said conveyor means into an operating position astride a respective seat;

said feed means including first retaining means for feeding each portion at a second given linear speed (V2) along said second path, second retaining means for transferring each portion from said second path to said conveyor means and into said operating position, and drive means connected to and for operating said second retaining means at a third linear speed (V3) greater at all times than said second speed (V2);

said drive means cyclically varying said third speed (V3) so as to equal, instant by instant and for a given length of time, the variable travelling speed (V) of said conveyor means to maintain said portions taut during said feeding and transferring.

6. A device as claimed in claim 5, wherein said first and second retaining means includes suction means cooperating with said portions.

7. A device as claimed in claim 5, wherein said first retaining means includes at least one suction belt extending at least in part along said second path, supporting rollers about which the suction belt is looped, and a motor connected to one of said supporting rollers for operating the belt at a linear speed equal to said second speed (V2).

8. A device as claimed in claim 5, wherein said second retaining means includes a suction roller interposed between and tangent to both said second path and said conveyor means.

9. A device as claimed in claim 7, wherein said second retaining means includes a suction roller coaxial with another of said supporting rollers.

10. A device as claimed in claim 8, wherein said drive means includes a brushless electric motor connected to said suction roller.

11. A device as claimed in claim 5, wherein said conveyor means includes a suction drum step-rotated about its axis, and the outer periphery of said suction drum having a number of said seats.

* * * * *

UNITED STATES PATENT AND TRADEMARK OFFICE

CERTIFICATE OF CORRECTION

PATENT NO. : 5,406,775
DATED : April 18, 1995
INVENTOR(S) : Alver Tacchi, et al

It is certified that error appears in the above-indentified patent and that said Letters Patent is hereby corrected as shown below:

On the title page: Item [30] Foreign Application Priority Data

Change "B092A0245 U" to --B092A0245--.

Signed and Sealed this

Twenty-ninth Day of August, 1995

Bruce Lehman

*Attest:*

BRUCE LEHMAN

*Attesting Officer*

*Commissioner of Patents and Trademarks*